US006751854B2

(12) United States Patent
Takiyama

(10) Patent No.: US 6,751,854 B2
(45) Date of Patent: Jun. 22, 2004

(54) SLIDE FASTENER FINISHING APPARATUS

(75) Inventor: Hironori Takiyama, Toyama-ken (JP)

(73) Assignee: YKK Corporation, Tokyo (JP)

( * ) Notice: Subject to any disclaimer, the term of this patent is extended or adjusted under 35 U.S.C. 154(b) by 91 days.

(21) Appl. No.: 10/118,049

(22) Filed: Apr. 9, 2002

(65) Prior Publication Data

US 2002/0144385 A1 Oct. 10, 2002

(30) Foreign Application Priority Data

Apr. 10, 2001 (JP) ..... 2001-110875

(51) Int. Cl.[7] ..... A41H 37/06

(52) U.S. Cl. ..... 29/767; 29/408; 29/33.2; 29/768

(58) Field of Search ..... 29/408, 766, 767, 29/768, 33.2

(56) References Cited

U.S. PATENT DOCUMENTS

| | | | | | |
|---|---|---|---|---|---|
| 3,530,563 | A | * | 9/1970 | Maeda | 29/33.2 |
| 3,789,487 | A | | 2/1974 | Kawakami | |
| 3,792,521 | A | * | 2/1974 | Kawakami | 29/768 |
| 4,416,060 | A | | 11/1983 | Nakagawa | |
| 4,479,290 | A | | 10/1984 | Osaki | |
| 4,520,560 | A | * | 6/1985 | Nakagawa | 29/768 |
| 4,629,054 | A | * | 12/1986 | Kondo | 29/768 |
| 4,747,210 | A | | 5/1988 | Suzuki | |
| 4,756,079 | A | * | 7/1988 | Kando | 29/768 |
| 4,771,522 | A | | 9/1988 | Osaki | |
| 4,809,414 | A | * | 3/1989 | Sawada | 29/33.2 |
| 4,974,315 | A | * | 12/1990 | Yunoki | 29/768 |
| 5,142,772 | A | * | 9/1992 | Ishikawa | 29/768 |
| 5,142,773 | A | * | 9/1992 | Yunoki | 29/768 |
| 5,208,970 | A | * | 5/1993 | Ishikawa | 29/768 |
| 5,241,742 | A | * | 9/1993 | Sawada | 29/767 |

FOREIGN PATENT DOCUMENTS

| | | |
|---|---|---|
| JP | 03-256053 | 1/1993 |

* cited by examiner

*Primary Examiner*—David P. Bryant
(74) *Attorney, Agent, or Firm*—Finnegan, Henderson, Farabow, Garrett & Dunner, L.L.P.

(57) ABSTRACT

A pair of coupled right and left element rows of a fastener chain is inserted from a rear opening of a slider, which is placed and fixed on a slider passing portion disposed on a transfer path of the fastener chain, and after the element rows are separated side by side through the slider passing portion the respective separated element rows are coupled again by inserting the element rows into an element coupling portion disposed at a chain downstream side. The fastener chain in the above state is transferred to a stop portion forming unit of a single stop implement disposed at a chain downstream side of the element coupling portion, so that the stop implement is attached thereto. Thus, steps for coupling the element rows of the fastener chain and attaching the single stop implement are performed continuously and efficiently.

13 Claims, 10 Drawing Sheets

SLIDE FASTENER FINISHING APPARATUS

BACKGROUND OF THE INVENTION

1. Field of the Invention

The present invention relates to a slide fastener finishing apparatus which forms a slider and a stop portion in a fastener chain and particularly, the present invention relates to a slide fastener finishing apparatus, in which a pair of right and left element rows as a fastener chain are inserted from a rear opening of a slider with being coupled each other, each of the element rows separated after insertion are coupled again and the stop portion for joining one element coupling end portion to other element coupling end portion is formed.

2. Description of the Related Art

Conventionally, a slide fastener finishing apparatus has been in heavy use in order to obtain a slide fastener finished product by mounting a slider and a stop portion to a fastener chain to be attached to a fly of pants, clothes, a bag or the like.

According to this conventional slide fastener finishing apparatus, for example, with a pull of a slider located on a lower side, the slider is held by a slider holding portion of a support table and respective front end portions of the fastener chain, of which element rows are separated from side to side, are held by fingers, so that these front end portions are inserted from a shoulder of the slider with right and left portions thereof being aligned. Respective element rows after insertion are discharged backward from a rear opening of the slider with being coupled and then, a lower stop implement, which is supplied to a lower stop portion forming portion disposed at a chain downstream side of the slider holding portion, is hammered into a fastener tape by a punch to be attached thereto. For example, an example of this kind of a slide fastener finishing apparatus is described in Japanese Patent Publication No. 51-185 and Japanese Patent Publication No. 59-48085.

Alternatively, for example, Japanese Utility Model Publication No. 6-36737 discloses a slider fit-in apparatus as other slide fastener finishing apparatus for attaching two sliders to a fastener chain with opposing their shoulders or rear openings each other. According to the slider fit-in apparatus disclosed in this publication, an upper plate of one slider is kept in a horizontal state by a slider holding portion disposed at an upper end portion of a slider holding block and the slider is held by gripping a pull hanging downward. In adjacent to the slider holding block, a rotary table, on which a plurality of slider holding portions each having the same constitution are provided in the form of radiation, are arranged rotatably around a horizontal axis, so that the slider is sequentially held at the slider holding portion with rotating this rotary table by gripping a pull of the other slider to be sequentially transmitted from a supply portion. A shoulder or a rear opening of the other slider held at this slider holding portion is positioned with being opposed to the shoulder or the rear opening of one slider by the rotation of the rotary table.

The one slider holds the slider as described above in such a manner that the shoulder or the rear opening of the slider is directed to a chain introduction side by a manual labor to be supplied to the slider holding portion of the slider holding block with the pull of the slider is hanging. The other slider is held at the slider holding portion of the rotary table and rotated, and then the slider stops toward the chain introduction side under the condition that the shoulder or the rear opening of the slider is opposed to the shoulder or the rear opening of the one slider.

After the other slider is supplied, when the rotation of the rotary table stops, the fastener chain is transmitted to a fastener chain insertion position of the slider and the fastener chain is inserted from the shoulder or the rear opening of the pair of sliders held along a transfer path of the fastener chain.

Further, Japanese Patent No. 2631048 discloses one example of other slide fastener finishing apparatus. The slide fastener finishing apparatus disclosed in this publication comprises a lower stop implement attaching device for attaching a lower stop implement disposed at the chain upstream side along the transfer path of the fastener chain and a slider holding device for attaching the slider disposed rotatably at the chain downstream side of the lower stop implement attaching device around the horizontal axis. The fastener chain is transmitted from the chain upstream side to the downstream side across the lower stop implement attaching device and the slider holding device by a gripper device.

In order to finish the slide fastener with using this conventional slide fastener finishing apparatus, it is necessary for the slider to be supplied to a slider supplying position located above the slider holding device with hanging the pull and directing the shoulder of the slider toward the chain introduction side. In the supplied slider, the pull of the slider is held at the slider holding device and then, the slider holding device is rotated by 180 degrees downward, so that the pull of the slider is held at a front side to make the slider stand at a slider insertion position.

A pair of right and left element rows of a fastener chain is gripped by the gripper device with being coupled, transmitted along the transfer path of the fastener chain and inserted from the rear opening of the slider, so that the slider is mounted to the fastener chain. After that, under the condition that the element rows are coupled, the lower stop implements are attached for each required length of the fastener chain from the upper plate side of the slider by the lower stop implement attaching device disposed on the chain upstream side of the slider holding device and then, the fastener chain is cut.

Alternatively, as other slide fastener finishing apparatus, for example, Japanese Patent Publication No. 59-51819 discloses the lower stop implement attaching apparatus, which forms a space in the continuous element rows as well as hammers the lower stop implement into a fastener tape at the end portion of this space by shearing and cutting a portion of a head in the element rows of the fastener chain to be transferred with the pair of right and left element rows engaged each other.

Further, Japanese Patent Publication No. 6-71446 discloses a slide fastener manufacturing apparatus for attaching a lower stop implement by a lower stop implement attaching device disposed at an upstream side of a chain of a slider holding device in such a manner that a front end of a fastener chain with the element rows being closed is gripped by a gripper device, the fastener chain is inserted from a rear opening of a slider held by the slider holding device with the pull being located on the underside thereof and the element rows are separated.

Generally, in the case of obtaining a slide fastener finished product by attaching a single slider and a stop implement to a fastener chain, for example a pair of separated upper stop implements is formed at one end of the fastener chain in advance and then, other end portion of the fastener chain is inserted from a shoulder of the slider under the condition that the right and left element rows of the fastener chain are separated. After respective inserted element rows are transmitted backward from the rear opening of the slider with being engaged with each other, the lower stop implement for connecting element coupling end portions is formed in the fastener chain.

By the way, for example, in a traveling bag opened and closed by a slide fastener, there is a case that a single slider is inserted in a fastener chain and the stop implements for connecting element coupling end portions are formed respectively at the opposite ends of this chain.

In order to finish the slide fastener to be used for the opening portion of such a traveling bag or the like, at first, a stop implement for connecting the element coupling end portions is formed at a portion inlying by a certain length from one end of the fastener chain whose element rows being coupled with each other. After that, the one end is inserted in the rear opening of the slider, so that the element rows of the fastener chain are separated. The front end portions of the separated element rows are coupled by a manual labor, so that a stop implement having the same constitution as that of said stop implement is formed at a front end portion of the coupled element rows.

Alternatively, for example, in a boiler suit, there is a case that it is required that its fly is opened from the both of the upper and the lower sides. Upon finishing a slide fastener to be used for the fly of this boiler suit, in order to attach two sliders and stop implements to a fastener chain, it is necessary for the two sliders to be inserted in the fastener chain under the condition that the rear openings of the sliders are opposed to each other. In the case of obtaining such a slide fastener finished product, an upper stop implement is formed at one end of the slide fastener in advance and the fastener chain with the right and left element rows being separated is supplied along a fastener chain transfer path of a slide fastener finishing apparatus.

The supplied fastener chain is inserted from a shoulder of one slider, which is fixed and supported on the transfer path in advance, and then, the fastener chain is transmitted backward from the rear opening of the slider with the right and left element rows being coupled with each other. Continuously, the fastener chain with the right and left element rows being closed has been continued to be supplied along the transfer path, so that the fastener chain is inserted in the rear opening of other slider, which has been fixed and supported on this transfer path in advance. Then, the fastener chain with the inserted right and left element rows being opened is transmitted from the shoulder of the slider toward the chain transfer direction. After these element rows of the fastener chain with the right and left element rows being opened are coupled with each other by a manual labor, a stop implement for connecting the element coupling end portions is formed.

Normally, upon attaching a single stop implement such as a lower stop implement to a fastener chain, it is needed that the element rows of the fastener chain located at the stop implement attaching position should be closed. However, as described above, in the fastener chain to be pulled out from the shoulder side of the slider, the right and left element rows are separated, so that, if a stop implement for connecting the element coupling end portions is formed there, as described above, it is necessary for the separated right and left element rows to be coupled by a manual labor at once.

In this way, under the condition that the right and left element rows are opened, the fastener chain is transmitted from the shoulder of the slider. Then, the fastener chain with the right and left element rows being opened is coupled by a manual labor, so that the element rows are closed and in this condition, the element coupling end portions are supplied to a stop implement forming device for connecting the element coupling end portions, thereby forming a stop implement. Therefore, between the manual work and the lower stop implement attaching operation, the operation temporally breaks off, so that the continuous operation is not capable of being performed. This makes the working efficiency lowered and further, this makes it difficult that the fastener chain is continuously and automatically finished.

SUMMARY OF THE INVENTION

The present invention has been achieved in order to solve the above conventional problems. A concrete object of the invention is to provide a slide fastener finishing apparatus capable of continuously and effectively performing a coupling step of element rows of a fastener chain and a forming step of a stop portion in such a manner that a slider is inserted from its rear opening with a pair of right and left element rows of the fastener chain being coupled each other, separating side end portions of the inserted element rows are mechanically coupled and it enables to continuously form the stop portion for connecting these element coupling end portions.

Specifically, according to a slider fastener finishing apparatus of the invention, the slider is inserted from its rear opening with a pair of right and left element rows of a fastener chain being coupled and the separating side end portions of the inserted element rows are connected each other. The slider fastener finishing apparatus comprises a slider passing portion which is disposed on a transfer path of the fastener chain and holds the slider with directing the rear opening of the slider toward the introduction side of the fastener chain, and an element coupling portion disposed at the chain downstream side of the slider passing portion.

According to this slide fastener finishing apparatus, the rear opening of the slider is held toward the introduction side of the fastener chain at a slider passing portion laid on the transfer path of the fastener chain, the pair of right and left element rows of the fastener chain with being coupled with each other are inserted in the rear opening of the slider and the separating side end portions of the element row, which have been transmitted from the shoulder of the slider, are inserted in the element coupling portion disposed at the chain downstream side of the slider passing portion to couple the respective element rows again, so that it is possible that the stop portions for connecting the element coupling end portions are formed at the front ends of the respective element rows with being closed.

Further, on the transfer path of the fastener chain, the fastener chain is inserted from the rear opening of the slider and the element rows of the fastener chain with the element rows being separated are mechanically coupled again, so that it becomes possible to continuously perform the coupling operation of the fastener chain and the forming operation of a stop portion to connect the element coupling end portion. Thus, it is possible to extremely improve the work efficiency, to increase the productivity, to decrease the manufacturing cost and further, to decrease the burden of an operator.

Alternatively, it is possible to comprise a constitution such that the slider passing portion has a fitting concave portion for fitting and supporting a lower plate of the slider as well as has a suction opening on its bottom.

According to such a constitution, it is possible to Ad position and fix the slider by a suction force at the fitting concave portion of the slider passing portion via a sucking hole, which is formed at a bottom of this fitting concave portion with the rear opening of the slider being directed toward the introduction side of the fastener chain and its lower plate being fit and supported. Therefore, despite of a simple constitution for setting the slider it is possible to certainly and stably position and fix the slider. As a result, it is possible to accurately and smoothly insert a fastener chain to be transmitted on the transfer path of the fastener chain in the slider.

Alternatively, it is possible to comprise a slider fixing member movable up and down having contact surface, which contacts a part of an upper surface of the slider on its lower face side, on an upper part of the slider passing portion.

According to such a constitution, the slider fixing member comes down from a waiting position at an upper position of the transfer path of the fastener chain toward the slider passing portion so as to abut against a part of an upper face of the slider which is fit and supported in the fitting concave portion of the slider passing portion and further, to clip and fix the slider so that it does not move. At the same time, it is possible to insert the above fastener chain in the slider from the rear opening. In this case, even if the external force is effected on the slider by a slide contact of the fastener chain, it is possible to make the slider unmovable, so that there is an advantage such that the smooth and stable insertion operation of the fastener chain is performed.

Further, it is possible to comprise a constitution such that the slider fixing member further has an introduction guide portion of the fastener chain and a chain introduction opening of the introduction guide portion has an inclined surface inclined downward in the chain introduction direction.

According to such a constitution, the slider may be fixed between the slider fixing member and the fitting concave portion of the slider passing portion as well as the fastener chain may be introduced and guided toward a inside of the slider from the chain introduction opening of the introduction guide portion of the slider fixing member. Since the chain introduction opening of the introduction guide portion is formed to an inclined face inclined downward toward the chain introduction direction, even if the upper and lower introduction positions of the fastener chain is slightly displaced, it is possible to guide the fastener chain from the inclined face to the inside of the slider and smoothly insert the fastener chain in the slider.

Further, it is possible that the element coupling portion has an introduction guide space for aligning and introducing the element rows separated at the slider passing portion, and an element coupling space for coupling the elements of the element rows disposed at the chain downstream side of the introduction guide space and separated.

According to such a constitution, the fastener chain transmitted from the slider passing portion with the element rows being separated are aligned and guided in the introduction guide space of the element coupling portion to be inserted therein and these aligned element rows are transmitted in the element coupling space disposed at the chain downstream side of the introduction guide space, so that it is possible to couple the element rows each other again.

Thus, the fastener chain, of which element rows to be transmitted from the slider passing portion are separated, is introduced and guided to the element coupling portion along the transfer path of the fastener chain and the separated element rows are automatically coupled only by passing the element coupling portion, so that it is possible to effectively and continuously shift the coupling step of the fastener chain to a next stop portion forming step without the troublesome work.

Further, it is possible to provide a constitution such that the element coupling portion moves up and down in cooperation with the slider fixing member.

According to such a constitution, the element coupling portion and the slider fixing member are disposed on the same horizontal surface in the upper position of the transfer path of the fastener chain, so that they can move up and down toward the fastener chain in cooperation with each other. The both of the element coupling portion and the slider fixing member can come down from a waiting position in the upper position of the fastener chain transfer path toward the fastener chain transfer path by a desired distance, i.e., they can come down up to the upper contacting position of the slider fitted with the fitting concave portion formed on the slider fixing position on the fastener chain transfer path. Therefore, the lower face of the element coupling member of the element coupling portion abuts on the upper surface of the fastener chain transfer path, so that it is possible to continuously and linearly form the fastener chain transfer space between the element coupling portion and the slider fixing member, and the fastener chain transfer path.

Alternatively, in the fastener chain transfer space including the element coupling portion and the slider fixing position, the element rows are introduced to the slider fixing position with being coupled, the element rows to be separated side by side upon passing through the slider fixing position are aligned on the same plane to be introduced and guided toward the next element coupling portion and the separated element rows are coupled again while they are passing through the element coupling portion, so that it is possible to shift the step to a next stop portion forming step smoothly.

After forming the stop portion, the both of the element coupling member and the slider fixing member simultaneously rise and return to the waiting position in the upper portion of the fastener chain transfer path and the fastener chain transfer path right below the element coupling portion and the slider fixing member is released, so that it becomes possible to easily and smoothly take out the fastener chain finished product. After the fastener chain finished product is taken out from the transfer path, a next slider is fit with the fitting concave portion of the slider fixing position. Hereafter, the above described operation may be repeated.

As understood from the above, the element coupling member and the slider fixing member can move up and down in cooperation with each other, so that it becomes possible to assemble them in the same support frame to be unitized. Therefore, there is an advantage capable of downsizing the apparatus.

Further, it is possible to provide interval changing means for enabling an interval between the element coupling portion and the slider fixing member to be changed.

According to such a constitution, for example, it is possible to constitute the element coupling portion and the slider fixing member so that they are fixed and supported slidably by a common support frame. Further, it is possible to change the interval between the element coupling portion and the slider fixing member along the transfer path of the fastener chain. By changing the interval between the element coupling portion and the slider fixing member, it becomes possible to freely set an interval between the element coupling portion and the slider fixing member depending on the flexibility and the length of a slide fastener as a finished product. Alternatively, in the interval changing means, a conventionally known constitution whereby the element coupling portion and the slider fixing member are slidable with respect to the support frame may be applied.

Further, in the slide fastener finishing apparatus, it is possible to provide a constitution such that a stop portion forming unit is further disposed at the chain downstream side of the element coupling portion to connect the coupling end portions of the right and left element rows.

According to such a constitution, after the right and left element rows separated at the slider passing portion are coupled again at the element coupling portion, it is possible to transfer these element rows to the stop portion forming unit for a single stop portion disposed at the downstream side thereof. Then, at this stop portion forming unit, it is possible to form a stop portion for integrally connecting the coupling end portions of the coupled element rows.

Alternatively, as the stop portion, a metal stop portion having a conventional lateral C-shape or a lateral H-shape in section or the like may be used and an element coupling end portion may be fused directly or via a fused tape piece to form a fused stop portion. The stop portion forming unit according to the present invention may comprise a punch and a die, and further, may be provided with a heating and fusing device and a supersonic fusing device or the like.

Further, a fastener chain to be transferred from the element coupling portion is capable of being transferred to the stop portion forming unit continuously along the transfer path of the fastener chain, so that it becomes possible to continuously perform the stop portion forming operation after the coupling operation of the fastener chain. Additionally, by sequentially providing the slider passing portion, the element coupling portion and the stop portion forming unit having such a constitution, for example, it also becomes possible to automate all the operations by the use of well known transfer means of a fastener chain, for example, consisting of a gripper or the like.

Further, in the slide fastener finishing apparatus, it is possible to provide a constitution such that the stop portion forming unit may be provided movably up and down toward the fastener chain, and stop portion forming member for forming the stop portion at the coupling end portion of the fastener chain and a tape pressing and holding member for pressing and holding the right and left fastener tapes to a support table are provided movably up and down toward the fastener chain.

According to such a constitution, when the fastener chain is transferred from the fastener chain transfer path right below the element coupling portion and the slider fixing member to the stop portion forming unit, before the stop portion forming unit does not come down, it is possible to come down the tape pressing and holding member individually toward the fastener chain on the road that the stop portion forming unit is coming down and between this stop portion forming unit and the support table and further, it becomes possible to position and fix the right and left fastener tapes by pressing and holding them with respect to the support table with overpassing the element rows. After the fastener chain is positioned on the support table to be fixed in the immovable condition, the above described formation of the stop portion is performed by the stop portion forming unit. Therefore, the fastener chain is not moved in vain, so that it becomes possible to accurately form the stop portion.

Further, in the slide fastener finishing apparatus, it is possible to comprise a constitution such that the tape pressing and holding member is disposed between the stop portion forming unit and the support table, has an insertion guide path through which the stop portion forming unit are capable of being inserted, and presses and holds the right and left fastener tapes on the support table with overpassing the element rows.

According to such a constitution, the tape pressing and holding member can be disposed on the lower position of the stop portion forming unit when the stop portion forming unit is not operated, so that the pressing and holding member may come down at first and the stop portion forming unit may come down after pressing and holding the right and left fastener tale of the fastener chain. Because the stop portion forming unit comes down within an insertion path of the tape pressing and holding member, it is possible to form the stop portion at the element coupling end portion of the fastener chain.

Alternatively, the tape pressing and holding member can press and hold the fastener tape in the vicinity of the element coupling end portion for forming the stop portion, so that the element coupling end portion is prevented from being displaced upon forming a stop portion and it is possible to form the stop portion in a stable condition. Further, the stop portion forming unit can form a stop portion under the condition that the stop portion forming unit is inserted through the insertion path of the tape pressing and holding member, so that it is possible to prevent the stop portion forming unit from coming in contact with a finger of the operator upon forming a stop portion, thereby securing safety of the operation.

If an interval between the lower face of the tape pressing and holding member and the support table is set to be narrower so that a finger of the operator is not capable of inserting therein, it is possible to certainly prevent the contact between the stop portion forming member and the operator's finger.

Further, the slide fastener finishing apparatus may comprise a tube for guiding the movement back and forth of the stop portion forming unit in the tape pressing and holding member.

According to such a constitution, the stop portion forming unit can insert in a tube of the tape pressing and holding member with pressing an upper surface of the stop piece for forming the stop portion and transfer the stop piece toward the element coupling end portion of the fastener chain. Since the transfer of the stop piece is guided by the tube, a posture of the stop piece is not changed during the transfer, so that it is possible to supply the stop piece to the element coupling end portion in a right posture and to form the stop portion in a stable manner.

In addition, in the slide fastener finishing apparatus, the stop portion forming unit may comprise a cutting punch for cutting a linear material as a raw material of a stop portion into a stop piece having a certain length and folding it in a substantially reversed U-shape and a driver punch for pressing the upper surface of the stop piece and hammering this piece into the fastener tape, and the tape pressing and holding member may comprise the tube which provides the falling position of the cutting punch as well as guides the falling of the driver punch.

According to such a constitution, in order to form the stop portion at the fastener chain in the stop portion forming unit, in the case that the stop portion is, for example, a lateral C-shaped metal stop portion, after the linear material as the raw material of the stop portion is supplied to an upper surface of a bender disposed right below the cutting punch, the cutting punch is let down toward the linear material for the stop portion, so that it is possible to cut the linear material by a certain length in accordance with the falling of this cutting punch. At this time, since the driver punch as one of the stop portion forming members is also let down together with the cutting punch, so that after cutting the linear material, the cutting punch is capable of folding the stop piece in a substantially reversed U-shape having two leg portions of which lower edges are opened with respect to the bender by further sending down the cutting punch and the driver punch.

After the stop piece is folded down, by further sending down the cutting punch, the bender moves to a position far from a falling down path of the cutting punch. Then, under the condition that the falling of the cutting punch is stopped, it is possible to continue the falling of the driver punch. Due to this falling of the driver punch, it is possible to hammer the stop piece folded in a substantially lateral C-shape into the fastener tape.

DESCRIPTION OF THE PREFERRED EMBODIMENTS

Hereinafter, a preferable embodiment according to the present invention will be explained with reference to the accompanying drawings.

Figure 1:
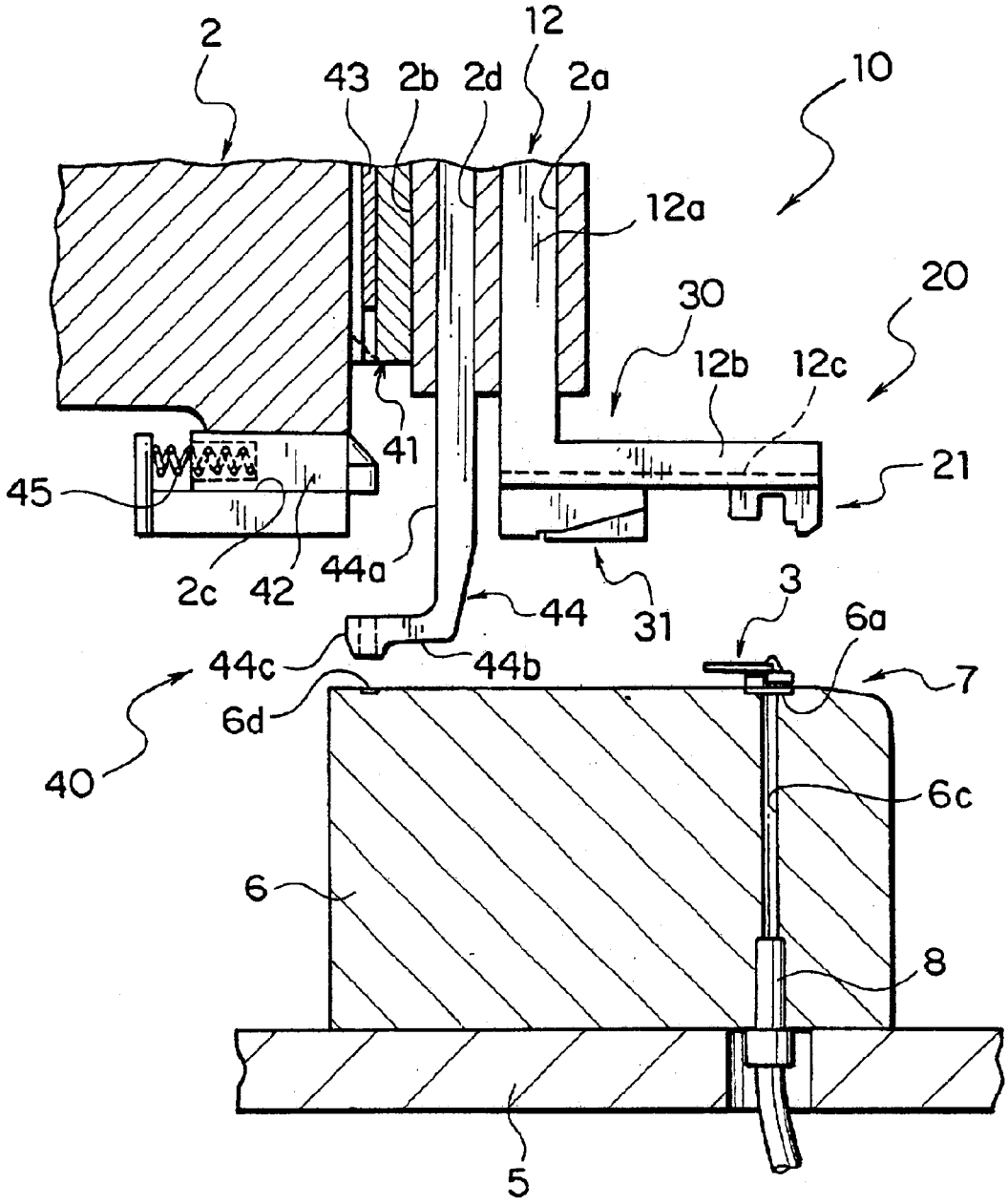
FIG. 1 is a longitudinal sectional view for schematically showing a slide fastener finishing apparatus.
Figure 2:
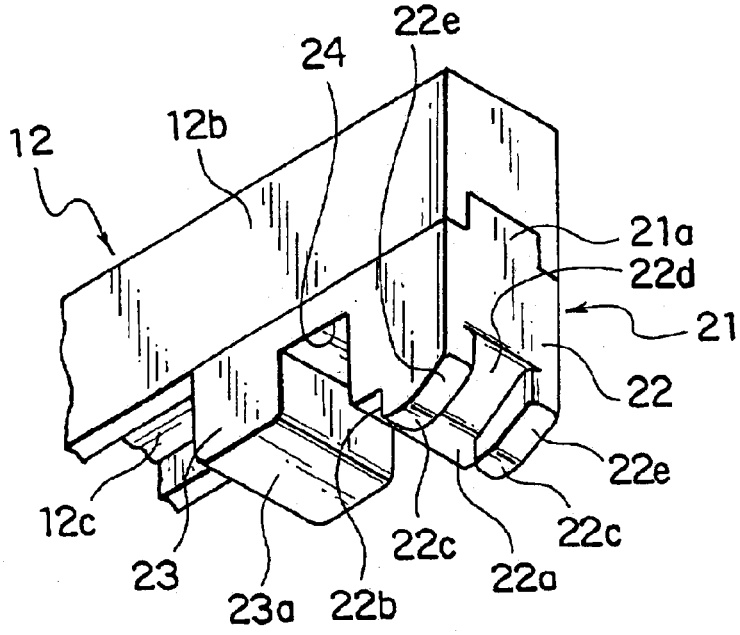
FIG. 2 is an enlarged perspective view for showing a substantial part of a slider fixing member.
Figure 3:
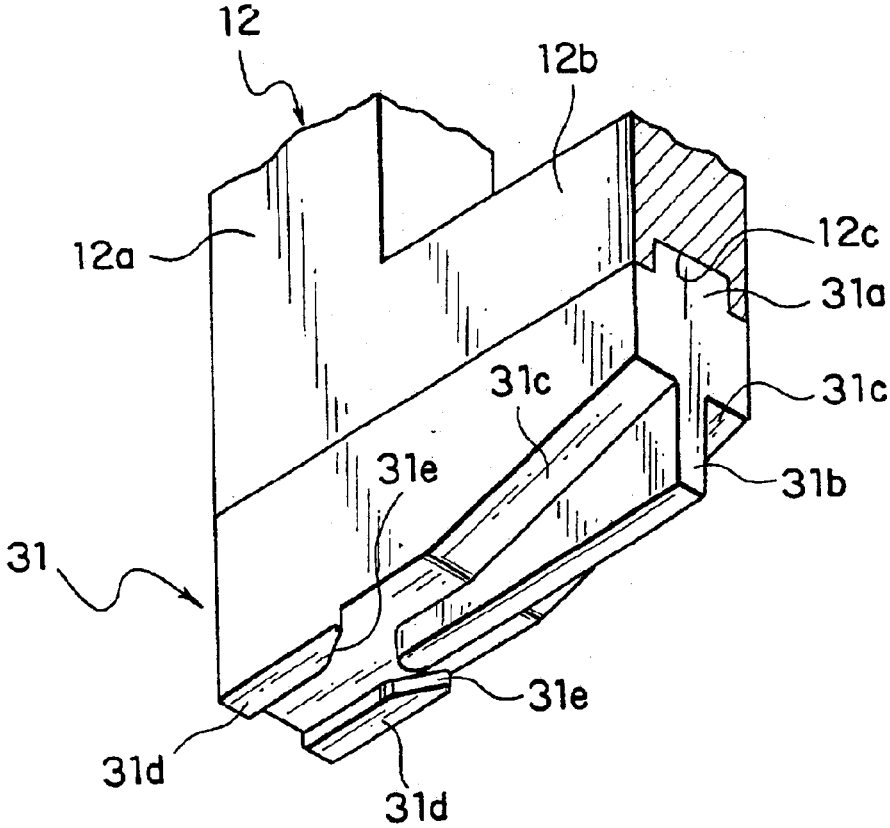
FIG. 3 is an enlarged perspective view for showing a substantial part of an element coupling member.
Figure 4:
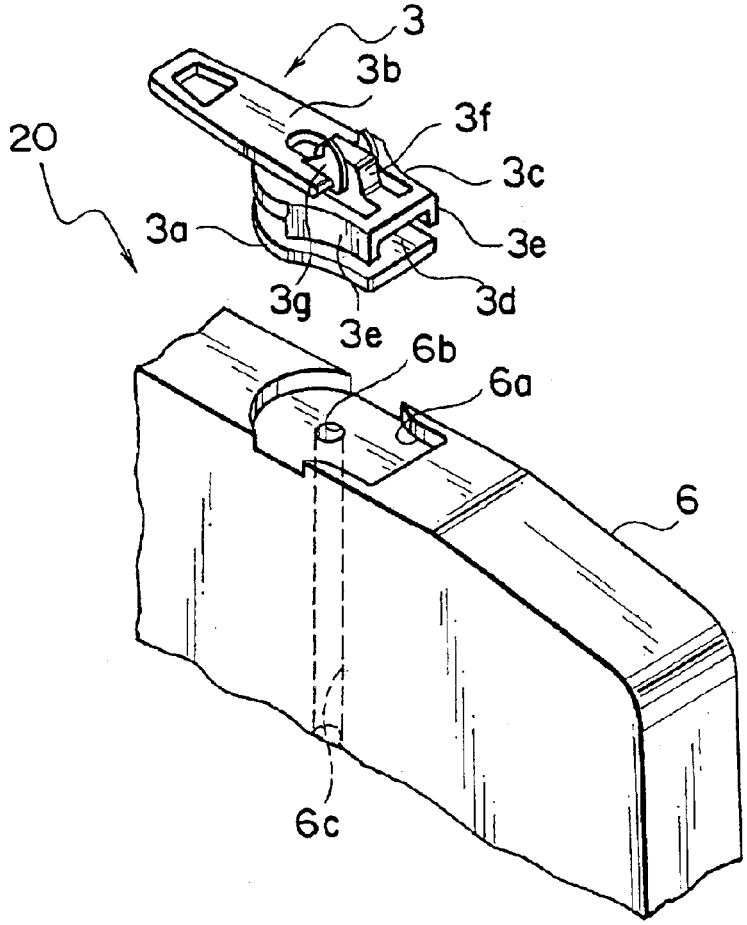
FIG. 4 is an enlarged perspective view for showing a support table and a slider.

FIG. 1 is a longitudinal sectional view for schematically showing a slide fastener finishing apparatus according to a typical embodiment of the invention, FIG. 2 is an enlarged perspective view for showing a slider fixing member to be applied for the apparatus, FIG. 3 is an enlarged perspective view for showing an element coupling member to be applied for the apparatus and FIG. 4 is an enlarged perspective view for showing a support table and a slider to be applied for the apparatus.

In FIG. 1, reference numeral 10 denotes a slide fastener finishing apparatus according to the present embodiment. FIG. 1 shows the slide fastener finishing apparatus 10, in which constitutional members of a slider passing portion 20, an element coupling portion 30 and a part of a stop portion forming unit 40 are sequentially provided on a support table 6 fixed on an upper surface of a base 5. A support frame 2 is provided above the support table 6 and the support frame supports other constitutional members such as the slider passing portion 20, the element coupling portion 30 and the stop portion forming unit 40.

The slider passing portion 20 comprises a fitting concave portion 6*a*, which supports a slider 3 from beneath and a slider fixing member 21, which contacts and fixes the slider 3 from above. The fitting concave portion 6*a* is formed on the upper surface of the support table 6 and the slider fixing member 21 is attached to a bent arm 12 in a substantially L-shape supported movably up and down by the support frame 2. This bent arm 12 is inserted through a penetrating hole 2*a* penetrating the support frame 2 in the vertical direction. The bent arm 12 comprises a vertical portion 12*a* stably sliding in a vertical direction by the penetrating hole 2*a* and a horizontal portion 12*b* elongated horizontally from a lower edge of the vertical portion 12*a* toward a introduction side of a fastener chain 4. The slider fixing member 21 is attached to a lower surface of an end of the elongating side of the horizontal portion 12*b*. An upper part of this vertical portion 12*a* is fixed and supported by driving means (not illustrated) which is movable up and down independently of the support frame 2.

As shown in FIG. 4, the fitting concave portion 6*a* fits and supports a lower plate 3*a* of the slider 3 under the condition that a rear opening of the slider 3 is directed to a chain upstream side of a chain transfer path 7. A suction opening 6*b* is provided on a bottom face of the fitting concave portion 6*a*. This suction opening 6*b* communicates with a suction path 6*c* provided in the vertical direction in an interior of the support table 6. As shown in FIG. 1, the suction path 6*c* is connected to a suction nozzle 8 of a suction device (not illustrated) provided to a lower part of the support table 6.

If a startup switch (not illustrated) provided in the slide fastener finishing apparatus 10 is turned on and the suction device is activated, air is sucked from the suction opening 6*b* through the suction path 6*c*. After activating the suction device, if the operator picks up the slider 3 or a pull 3*b* of the slider 3 by hand and places and fixes it in the interior of the fitting concave portion 6*a* with the rear opening of the slider 3 being directed to the upstream side of the chain under the condition that the pull 3*b* of the slider 3 is turned up and is turned over at the front end side of a shoulder of the slider 3, the slider 3 is positioned and fixed by a suction force of the suction device. In this way, a simple slider positioning constitution is obtained, so that it is possible to position and fix the slider 3 certainly and stably.

Meanwhile, the slider 3 may be automatically supplied from a slider supplying portion (not illustrated) within the fitting concave portion 6*a*. Additionally, according to this embodiment, the slider 3 is positioned by the suction force of air. However, the invention is not limited to such a way. For example, in the case that the slider 3 is made of a metal material, the bottom face of the fitting concave portion 6*a* may be composed of a magnet. Further, in the case that a stop portion 1 (hereinafter, mentioned as a stop implement) to be described later is attached to a fastener chain 4, the stop implement 1 is attached from a rear surface side of the chain 4. However, in this case, by providing, for example, mechanical means as disclosed in Japanese Patent No. 2631048, the rear surface of the slider may be turned up to be positioned and fixed within the fitting concave portion of the support table.

The bent arm 12 moves up and down between a waiting position at the upper part of the support table 6 and a slider fixing position on the support table 6, and it is automatically stopped at respective positions by a limit switch (not illustrated). When the bent arm 12 has completely moved down from the waiting position toward the slider fixing position, a sensor (also, not illustrated) senses this state, so that the suction by the suction device is stopped.

As shown in FIG. 2, the slider fixing member 21, which is disposed at the front end portion of the lower surface of the horizontal portion 12*b* of the bent arm 12, is composed of a block body, of which side shape is a substantially reversed concave shape. On the upper part of the slider fixing member 21, a protruding line portion 21*a* is provided such that it is slidably fitted in a long groove 12*c*, which is formed along a longitudinal direction in a substantially central part in a width direction at the lower surface of the horizontal portion 12*b* of the bent arm 12. By an attaching bolt (not illustrated) which is inserted in an attaching hole (also, not illustrated) defined in the horizontal portion 12*b*, the slider fixing member 21 is detachably fixed on a lower part of the horizontal portion 12*b*.

The slider fixing member 21 has an introduction guide portion 22 for the fastener chain 4 and a pull contact portion 23. The introduction guide portion 22 is provided at the fastener chain introduction side of the slider fixing member 21 and it has chain guide protruding pieces 22*c* at the right and left sides of a downward inclined surface 22*d* directed to an inner part. The front ends of the downward inclines surface 22*d* and the chain guide protruding pieces 22*c* have a common horizontal surface and this horizontal surface composes a first contact surface 22*a* contacting the upper surface of an upper plate 3*c* of the slider 3. On the other hand, a front surface of the chain guide protruding pieces 22*c* composes a second contact surface 22*b* contacting a rear end surface of the rear opening side of the upper plate 3*c* of the slider 3.

The downward inclined surface 22*d* formed between the protruding pieces 22*c*, 22*c* can easily guide an element row 4*a* of the fastener chain 4 to the rear opening of the slider 3 between the protruding pieces 22*c*, 22*c*. A front end edge portion at the chain introduction side of each of the protruding pieces 22*c* has tape guide face 22*e*, of which edge is cut off at an angle downward toward the chain introduction direction with the substantially same inclination as the downward inclined surface 22*d*. By providing the tape guide faces 22*e*, the fastener tape 4*b* of the fastener chain 4 can be easily inserted in a gap between the protruding pieces 22*c* and the support table 6.

The pull contact portion 23 of the slider fixing member 21 is provided at the chain downstream side of the introduction guide portion 22 with required interval to contact with pressure the pull 3*b* directed toward the shoulder side of the slider 3, which is fitted in the fitting concave portion 6*a* of the fastener chain transfer path 7, from the upper face. Therefore, the pull contact portion 23 is made of a rectangular block body and a height of a pull contact face 23*a* is set to be lower than the height of the first contact surface 22*a* of the introduction guide portion 22 by the thickness of the pull 3*b*.

A space portion 24 to be defined between the introduction guide portion 22 and the pull contact portion 23 becomes a space for containing a pull connecting ring 3*f* of the slider 3 when the slider fixing member 21 comes down and it contacts the slider 3 fitted on the fastener transfer path 7.

Figure 5:
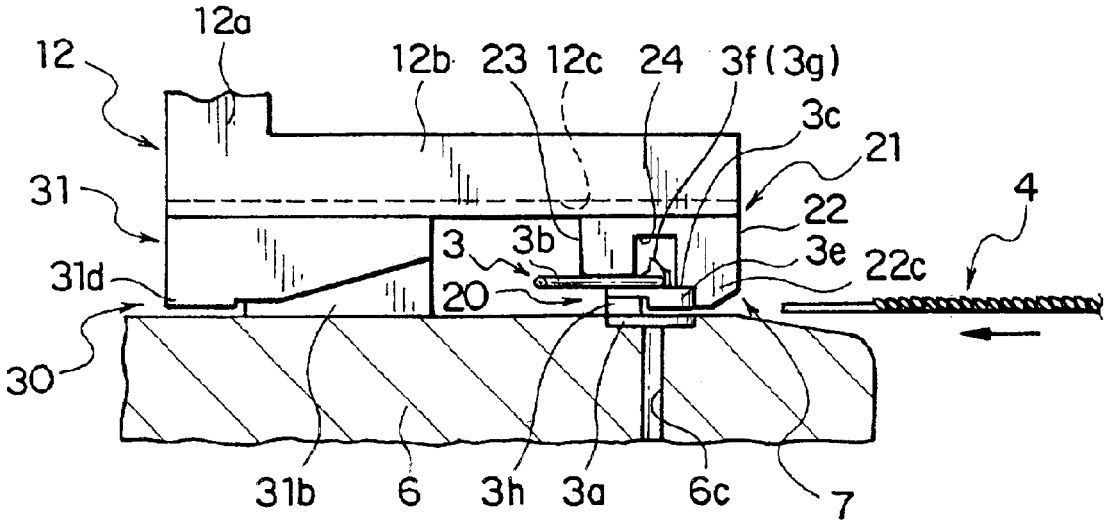
FIG. 5 is a typical view for showing a condition just before a fastener chain is inserted in the slider.

FIG. 5 is a typical view for showing a condition just before the fastener chain 4 is inserted in the slider 3. In the figure, under the condition that the pull 3*b* provided on the upper plate 3*c* of the slider 3 is turned up and is turned over at a chain transfer direction, the lower plate 3*a* of the slider 3 is fitted and fixed within the fitting concave portion 6*a* of the support table 6. When the operator turns on the foot switch (not illustrated), the bent arm 12 starts to come down. If the bent arm 12 comes down toward the slider fixing position by a require distance, the first contact surface 22*a* near the chain upstream side fixed to the bent arm 12 contacts the upper surface of the upper plate 3*c* of the slider 3 and the second contact surface 22*b* contacts the upper plate 3*c* and a rear end face of a guide flange 3*e* of the slider 3, so that the slider 3 is pinched and fixed.

A pair of right and left protruding pieces 22*c* provided in the introduction guide portion 22 is disposed at the chain introduction opening side with leaving a space between itself and the support table 6, whereby the fastener tape 4*b* of the fastener chain 4 can be inserted. The contact face 23*c* of the pull contact portion 23 located at the downstream side of the introduction guide portion 22 abuts against the upper surface of the pull 3*b* turned over at the front end side of the shoulder of the slider 3, so that it pinches and fixes the slider 3. In this case, the pull connecting ring 3*f* and a locking pawl 3*g* of the slider 3 are contained within the space portion 24 of the slider fixing member 21.

In this way, after the slider 3 is pinched and fixed immovably under the condition that the rear opening of the slider 3 is directed to the introduction side of the fastener chain 4 at the slider passing portion 20, the operator picks up the front end portion of the fastener chain 4, in which respective element rows 4*a* are coupled, and introduces the fastener chain 4 from the chain introduction opening of the introduction guide portion 22, which is formed between the protruding pieces 22*c* of the slider fixing member 21, toward the rear opening of the slider 3. Then, the fastener chain 4 is introduced from the rear opening of the slider 3 and passes through a post portion 3*h*. Under the condition that respective element rows 4*a* are separated side by side again, the front end portion of the fastener chain 4 is sent out from the shoulder of the slider 3 toward the element coupling portion 30 as a next step.

This element coupling portion 30 is composed of an element coupling member 31 and the support table 6. The element coupling member 31 is attached to a side end of an bent portion in the horizontal portion 12*b* of the bent arm 12, to which the slider fixing member 21 of the slider passing portion 20 is attached, and it moves up and down in cooperation with the slider fixing member 21. The element coupling portion 30 introduces and guides the fastener chain 4 to be transferred from the slider passing portion 20 with the right and left element rows 4*a* being separated, so that it couples respective element rows 4*a* again.

The element coupling member 31 is disposed on the same horizontal face as the slider fixing member 21 at the upper part of the chain transfer 7. As shown in FIG. 5, the both of the slider fixing member 21 and the element coupling member 31 come down together from the waiting position at the upper part of the chain transfer path 7 to a contact position with the upper surface of the slider 3, which is placed and fixed within the fitting concave portion 6*a* of the support table 6. In this case, the lower surface of the element coupling member 31 abuts against the upper surface of the support table 6 to form a linearly continued chain transfer space between the slider fixing member 21 and the support table 6.

As shown in FIG. 3, the element coupling member 31 is composed of a block body elongated toward the chain transfer path 7. The upper part of the element coupling member 31 has a protruding line portion 31*a* to be slidably fitted in the long groove 12*c* of the bent arm 12 as same as the slider fixing member 21 and it is fixed detachably by a bolt or the like on the lower part of the horizontal portion 12*b*. The element coupling member 31 and the slider fixing member 21 are assembled in the same support frame 2 to be unitized.

According to the embodiment, the both of the slider fixing member 21 and the element coupling member 31 are fixed and supported on a certain position in the single bent arm 12. However, the invention is not limited to this constitution. For example, a long hole is provided along the front and rear of the chain transfer direction on any one of the element coupling member 31 and the bent arm 12, so that it may be possible to attach the protruding line portion 31*a* of the element coupling member 31 to the bent arm 12 by the attaching bolt via the long hole.

In this case, after the attaching bolt is loosen to move through the long hole which is formed at the attaching side of the slider fixing member 21 or the element coupling member 31, if the attaching bold is fastened, it is possible to change a positional space between the slider fixing member 21 and the element coupling member 31. This can be constituted as positional space alternating means of the slider fixing member 21 and the element coupling member 31 according to the invention. It is possible to freely set the distance between the element coupling member 31 and the slider fixing member 21 depending on a difference in the flexibility and the length of the slide fastener as a finished product shown in FIGS. 12 to 15.

On a lower surface of the introduction side of the element coupling member 31, an introduction guide piece 31*b* in a tong shape is projected to introduce and guide the separated element rows 4*a* of the fastener chain 4. This introduction guide piece 31*b* is elongated and projected on a substantially center part in a width direction of the element coupling member 31 with overpassing from the front end portion of the chain upstream side to the middle portion thereof. On the opposite sides in a width direction of the introduction guide piece 31*b*, element row guide surfaces 31*c* are formed with being downwardly inclined toward the chain introduction direction. An introduction guide space to align and introduce the element rows 4*a* of the fastener chains 4, which are separated by the slider fixing member 21, is formed between the element row guide surfaces 31*c* and the introduction guide piece 31*b*, so that it is possible to easily introduce and guide the separated respective element rows 4*a* along the right and left wall surfaces of the introduction guide piece 31*b*.

At the chain downstream side of the introduction guide piece 31*b*, a pair of right and left side wall pieces 31*d*, 31*d* to couple the separated respective element rows 4*a* with each other is provided. These side wall pieces 31*d* are projected at the opposite side edge portions in a width direction of the element coupling member 31 with a smaller projection amount than that of the introduction guide piece 31*b* and they are elongated in parallel with the introduction guide piece 31*b*. The opposing wall surfaces of the ends at the chain upstream side of respective side wall pieces 31*d* comprise tapered surfaces 31*e* respectively, so that they become wider toward the introduction sides and narrower gradually toward the supplying direction. A space to be formed between the side wall pieces 31*d* is formed on elongation at the chain downstream side of the introduction guide piece 31*b* to constitute an element coupling space for coupling the separated element rows 4*a*.

Figure 6:
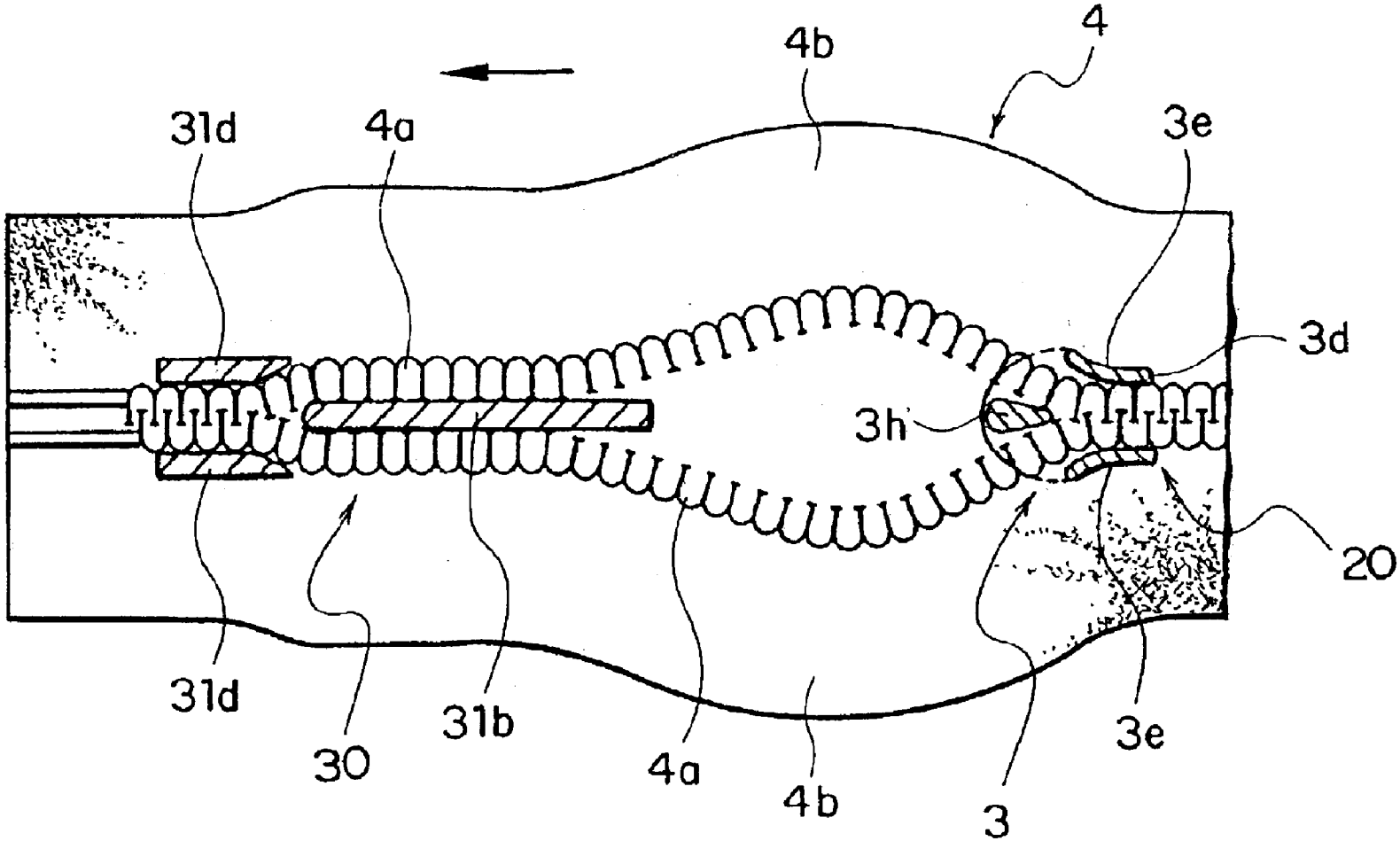
FIG. 6 is a typical view for showing a condition that a fastener chain is inserted from a slider passing portion to an element coupling portion.

FIG. 6 is a typical view for showing a condition that the fastener chain 4 is inserted from the slider passing portion 20 to the element coupling portion 30. In the figure, as described above, the operator sequentially inserts the fastener chain 4 from the rear opening 3d of the slider 3 which is disposed at the slider passing portion 20, in the insertion space between the guide flanges 3*e* and the right and left spaces of the post portion 3*h* as picking up the front end of the fastener chain 4 with the right and left element rows 4*a* being coupled. Then, the operator aligns the right and left element rows 4*a* from the shoulder of the slider 3 on the same plane and sends out them as separating them.

Next, the operator aligns the separated element rows 4*a* side by side, which are sent out from the slider passing portion 20, on the same plane in the introduction guide spaces, which are formed at right and left of the introduction guide piece 31*b* of the element coupling portion 30, and introduce them with picking up the front end portion of the fastener tape 4*b*. The aligned and introduced right and left element rows 4*a* are smoothly introduced in the element coupling space between the side wall pieces 31*d* via the tapered surfaces 31*e* of an entrance of the side wall piece 31*d*. While the separated fastener chain 4 passes through the element coupling space, the separated element rows 4*a* are automatically coupled again with each other. The fastener chain 4 with the right and left element rows 4*a* being coupled is sent in a next stop portion forming unit 40 by the operator.

In this way, after the fastener chain 4 with the element rows 4*a* being coupled is passed through from the rear opening of the slider 3 in the slider passing portion 20 to separate the element rows 4*a* side by side and the slider 3 is attached, the fastener chain 4 with the element rows 4*a* being separated, which has been passed through the slider passing portion 20, is introduced in the element coupling portion 30 and the separated element rows are automatically coupled again. Thus, without cutting off the operation, is it possible that the procedure efficiently and continuously shits to a next step for attaching a single stop implement.

Figure 7:
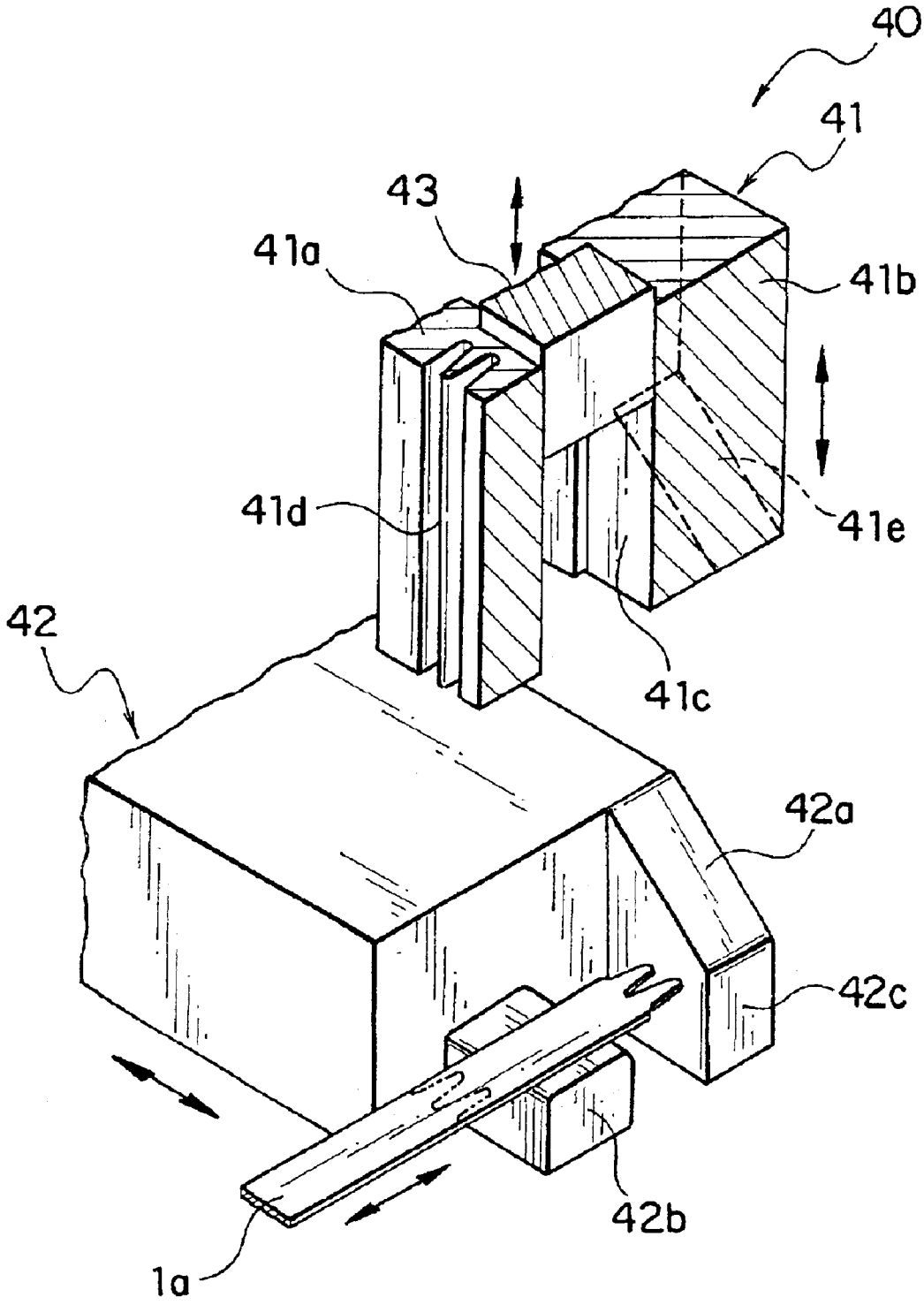
FIG. 7 is an enlarged perspective view for showing a substantial part of a stop portion forming unit.

FIG. 7 schematically shows a substantial part of a stop portion forming unit 40 according to a typical embodiment of the invention. In the figure, this stop portion forming unit 40 has a cutting punch 41 for cutting a linear material la as a raw material of the stop implement 1 into a stop piece with a required length, a bender 42 for bending the linear material 1*a* in a substantially reversed U-shape and a driver punch 43 for bending the linear material la in a substantially lateral C-shape and hammering it in the fastener tape 4*b* of the fastener chain 4. Further, the stop portion forming unit 40 has a tape pressing and holding member 44 for positioning and fixing the fastener tape 4*b* of the fastener chain 4 to the support table 6 by pressing and holding with overpassing the element rows 4*a* of the fastener chain 4.

The stop portion forming unit 40 is composed of the stop portion forming member such as the cutting punch 41, the bender 42, the driver punch 43 and the tape pressing and holding member 44, and the support table 6. These stop portion forming members 41 to 44 are guided and supported by the support frame 2 as well as they move up and down independently toward the fastener chain 4 transferred from the element coupling portion 30.

The cutting punch 41 is supported movably up and down by a penetrating hole 2*b* penetrating vertically at the front end portion of the support frame 2 as if clipping the driver punch 43. The driver punch 43 moves up and down together with the cutting punch 41. Upon attaching the stop implement, the driver punch 43 descends individually across a descending position of the cutting punch 41. The cutting punch 41 has a pair of first and second leg portions 41*a* and 41*b* with certain interval in the direction across the chain transfer path 7. The opposing inner wall surfaces of respective leg portions 41*a* and 41*b* have step portion shapes each forming a stepped shape and they form a wide and narrow space in a chain transfer direction through the step portions. This wide space between the step portions forms a slidable path 41*c* to slide the driver punch 43. The driver punch 43 relatively moves up and down within the slidable path 41*c* with respect to the cutting punch 41.

The first leg portion 41*a*, which is disposed on the introduction side of the linear material 1*a* of the cutting punch 41, has a blade portion 41*d* composed of two substantially triangle poles for cutting a cut portion of the linear material 1*a* in zigzag at its lower end. On the lower surface of the second leg portion 41*b* of the cutting punch 41, a cam face 41*e* inclined upward in the chain introduction direction is provided.

As shown in FIG. 1, a penetrating hole 2*c* penetrating horizontal in the chain introduction direction is formed at the lower end portion of the chain transfer side of the support frame 2. The bender 42 is inserted slidably against a pressing coil spring 45 within the penetrating hole 2*c* and the front end portion thereof elastically moves forward and backward from the front end portion toward the lower part of the cutting punch 41 and the driver punch 43.

At a front end portion of this bender 42, an anvil portion 42*b* in a substantially square pole is horizontally projected at a lower end central portion in parallel with a cam portion 42*c* to be described later on a side to which the linear material 1*a* is supplied. This anvil portion 42*b* constitutes a reception table for forming the linear material 1*a* into a substantially reversed U-shape with its lower part is opened together with the cutting punch 41. This anvil portion 42*b* is located at the lower part of the cutting punch 41 and reciprocates along the chain transfer path 7 in accordance with the ascending and descending of the cutting punch 41 between a position where the driver punch 43 projects in a track and a position where the driver punch 43 is evacuated outside of the track.

Alternatively, the cam portion 42*c* in a substantially trapezoid having a slope at the upper part thereof is projected horizontally at a position corresponding to the second leg portion 41*b* of the cutting punch 41 in the front end portion of the bender 42. The upper slope of the cam portion 42*c* is inclined to the opposite direction against the cam face 41*e* of the cutting punch 41 and it has a cam face 42*a* slidably contacting the cam face 41e. This bender 42 elastically moves backward to the chain downstream side through the cam face 42*a* in accordance with the descending of the cutting punch 41. In other words, by slidably contact of the cam face 42*a* of the bender 42 and the cam face 41*e* of the cutting punch 41, this bender 42 smoothly reciprocates for a certain distance in accordance with the timing. Further, for the reciprocation, a driving source is not needed particularly.

Further, between the element coupling member 31 and the cutting punch 41, the tape pressing and holding member 44 is provided in such a manner that it presses and holds the fastener tape 4*b* of the fastener chain 4 with respect to the support table 6 to position and fix it. As shown in FIG. 1, this tape pressing and holding member 44 is slidably contained in a penetrating hole 2*d* penetrating vertically between respective penetrating holes 2*a* and 2*c* of the bent arm and the cutting punch which are formed in the support frame 2. The tape pressing and holding member 44 is independently disposed movably up and down toward the fastener chain 4 between the waiting position with a required height and the support table 6.

The tape pressing and holding member 44 is bent in a substantially reversed L-shape contrary to the bent arm 12 and it is composed of an rising portion 44*a* and a horizontal portion 44*b*. This rising portion 44*a* of the tape pressing and holding member 44 Is supported movably up and down within the penetrating hole 2*d*. The horizontal portion 44*b* of the tape pressing and holding member 44 is elongated between the cutting punch 41 and the support table 6 and it is disposed so as to oppose the chain transfer path 7.

Figure 10:
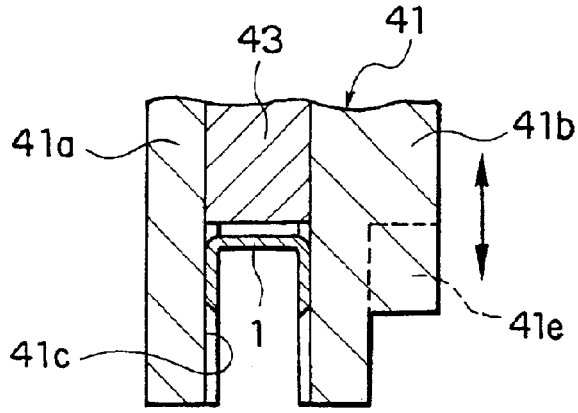
FIG. 10 is an explanatory view for showing the next operation shown in FIG. 9.
Figure 10:
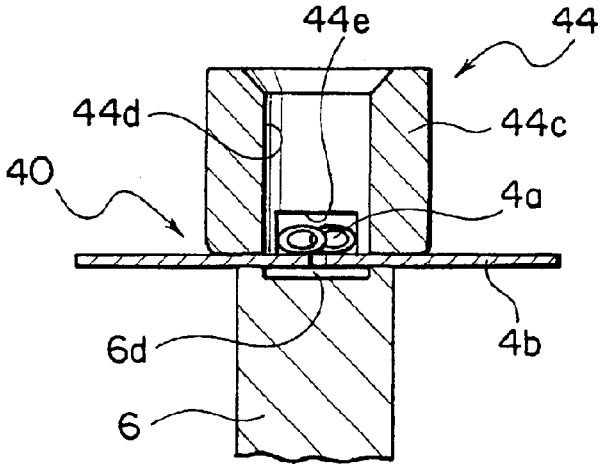
Figure 11:
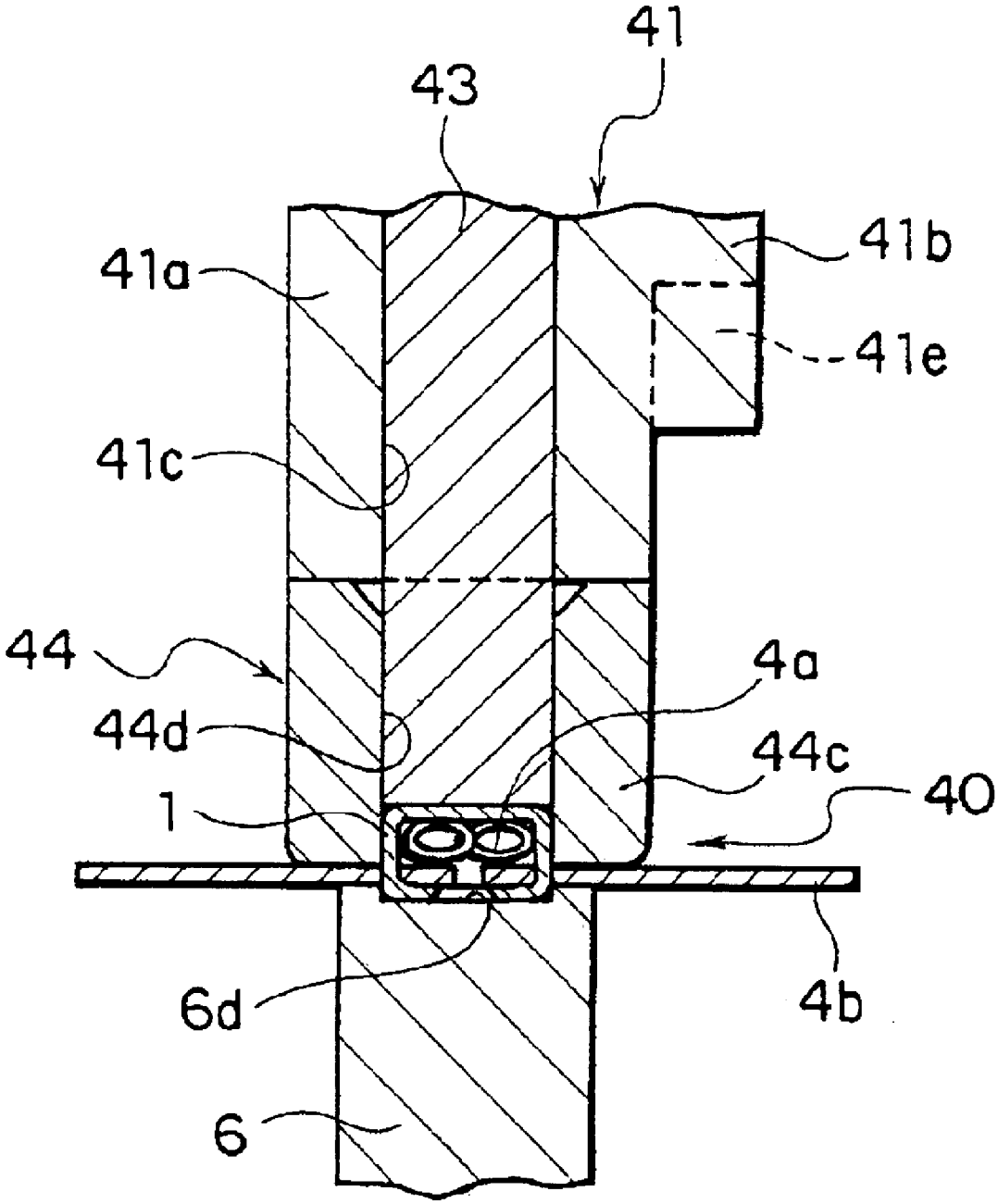
FIG. 11 is an explanatory view for showing the next operation shown in FIG. 10.

The horizontal portion 44*b* of the pressing and holding member 44 has a tube 44*c* penetrating vertically at the front end portion thereof. An upper end opening peripheral portion of this tube 44*c* constitutes a contact surface contacting the cutting punch 41. As shown in FIG. 10, the interior of the tube 44*c* has an introduction hole 44*d* with a size such that the driver punch 43 is capable of being introduced. This introduction hole 44*d* is defined as an insertion guide path for inserting and guiding the driver punch 43.

At a lower end opening peripheral portion of this tube 44*c*, an element containing groove 44*e*, which is formed along the chain introduction direction and is laid across the introduction hole 44*d*, is provided. The coupled element rows 4*a* of the fastener chain 4 are contained in the element containing groove 44*e*, so that, without interference with the element rows 4*a*, the fastener tape 4*b* is pressed to the support table 6 to be positioned and fixed. An interval between a lower end face position at the waiting position of the tube 44*c* and the chain transfer path 7 is defined as a narrow interval in which a finger of the operator is hardly inserted.

The tube 44*c* constituted as described above is located between the cutting punch 41 and the chain transfer path 7. The tube 44*c* regulates the descending of the cutting punch 41 as well as guides the further descending of the driver punch 43. In this case, the operator is not in danger of carelessly inserting one's finger in the space between the tube 44*c* and the chain transfer path 7, so that it becomes possible to safely and accurately hammer the single stop implement 1 in a reversed U-shape in the fastener tape 4*b* of the fastener chain 4.

Next, the operation of the stop portion forming unit 40 according to the present embodiment constituted as described above will be explained with reference to FIGS. 8 to 10.

Figure 8:
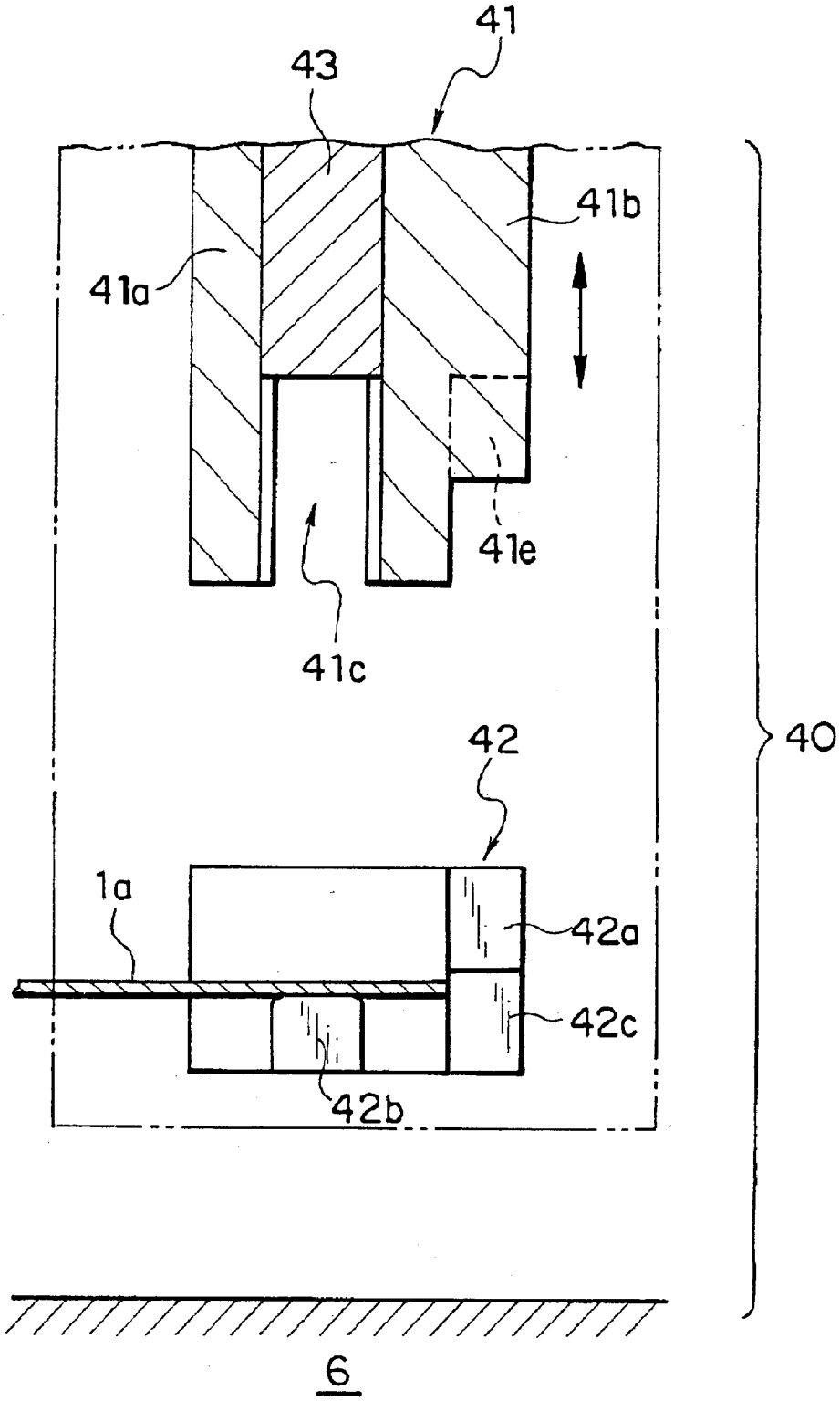
FIG. 8 is an explanatory view for showing the operation of the stop portion forming unit.

Before the fastener chain 4 passes through the slider passing portion 20 and the chain coupling portion 30, and the fastener portion forming portion of the fastener chain 4 attains the stop portion forming unit 40, as shown in FIG. 8, the operator feeds the linear material 1*a* made of metal to be supplied from a linear material supply device (not illustrated) in advance in the bender 42 as it gets across an upper face of the anvil portion 42*b* of the bender 42. If the stop portion forming part of the fastener chain 4 attains the stop portion forming unit 40, a foot switch (not illustrated) is pressed down. Prior to the descending of the cutting punch 41 and the A driver punch 43, the tape pressing and holding member 44 comes down independently toward the fastener chain 4 between the cutting punch 41 and the support table 6 and makes the coupled element rows 4*a* of the fastener chain 4 get across the concave groove 6*d* defined on the upper surface of the support table 6, so that it presses and fixes the fastener tape 4*b* at a periphery of this concave groove 6*d*.

Figure 9:
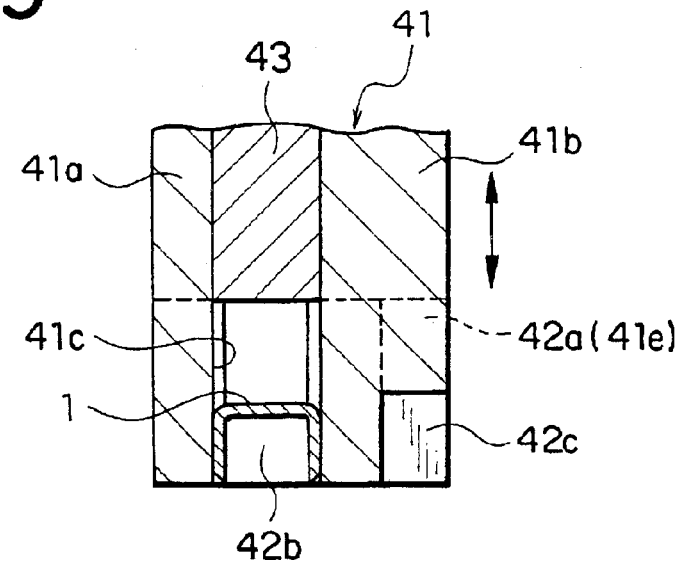
FIG. 9 is an explanatory view for showing the next operation shown in FIG. 8.

In this case, if the pressing of the tape 4*b* by the tape pressing and holding member 44 is confirmed by a detecting device (not illustrated), the detecting device (not illustrated) allows the cutting punch 41 and the driver punch 43 to start to come down simultaneously. If the cutting punch 41 comes down, the blade portions 41*d* of respective leg portions 41*a* and 41*b* of the cutting punch 41 cut the linear material 1*a* laid on the bender 42 into a certain length. At the same time of this cutting, the leg portions 41*a* and 41*b* press the linear material downward with overpassing the anvil portion 42*b* of the bender 42, as shown in FIG. 9, so that the opposite end portions of the out linear material 1*a* are bent in a substantially reversed U-shape having two legs, of which lower end is opened. In this way, after the single reversed U-shaped stop implement 1 is formed, the cutting punch 41 continues to come down. When this cutting punch 41 is coming down, the cam face 41*e* of the leg portion 41*a* slidably contacts the cam face 42*a* of the bender 42 and the bender 42 elastically feeds back toward the chain downstream side against the pressing coil spring 45 in connection with the anvil portion 42*b*.

At this time, as shown in FIG. 10, the stop implement 1 comes down with being clipped and held between the leg portions 41*a* and 41*b* of the cutting punch 41. If the leg portions 41*a* and 41*b* of the cutting punch 41 contact the upper surface of the tube 44*c* of the tape pressing and holding member 44, the descending of the cutting punch 41 is stopped. On the other hand, the driver punch 43 coming down in cooperation with the cutting punch 41 continues to come down after the cutting punch 41 is stopped and then, it is introduced in the introduction hole 44*b* of the tube 44*c* as pushing down the stop implement 1 clipped between the leg portions 41*a* and 41*b* of the cutting punch 41.

In accordance with the descending of the driver punch 43, two sharp leg portions of the stop implement 1 attain on the fastener tape 4*b*. Then the right and left leg portions of the stop implement 1 are penetrated through the right and left fastener tapes 4*b* with overpassing the coupled element rows 4*a* in the concave groove 6*d* defined on the upper surface of the support table 6. At the same time, the right and left leg portions of the stop implement 1, which are inwardly bent in a substantially lateral C-shape in the concave groove portion 6*d* by the pressing of the driver punch 43, are hammered in the fastener tape 4*b*.

In this way, when the attaching of the stop implement 1 is finished, the tape pressing and holding member 44 and the bent arm 12 also return to the upper waiting position above the chain transfer path 7 at the same time as the returning operation of the cutting punch 41 and driver punch 43 to the upper waiting position above the chain transfer path 7 is started and then, the all operations are stopped. Thus, after all steps are competed, the chain transfer path 7 is released, so that the fastener chain finished product is taken out. After the fastener chain finished product is taken out from the upper surface of the chain transfer path 7, a next slider 3 is fitted and fixed on the fitting concave portion 6*a* and the above described operation will be repeated.

In this way, on the chain transfer path 7, the fastener chain 4 with the element rows 4*a* being coupled is inserted from the rear opening 3*d* of the slider 3, then, the fastener chain 4 is further moved and the separated element rows 4*a* are automatically coupled again, so that it is possible to continuously feed the fastener chain 4 into the single stop implement attaching step. As a result, it is possible that the working efficiency is extremely improved and the productivity is increased as well as the manufacturing cost is decreased and further, the burden of the operator is also decreased.

According to this embodiment the stop implement 1 made of metal is formed by cutting the linear material 1*a*, however, the invention is not limited to this. For example, the stop implement 1 having an attaching pawl is formed in advance and the stop implement 1 is supplied to the stop portion forming unit 40 through a supplying chute, so that the stop implement 1 may be attached to a front side of the fastener chain 4. Alternatively, if the element rows of the fastener chain are made of a synthetic resin, by using the linear material for the stop implement made of a synthetic resin and supplying this linear material for the stop implement to the element rows of the fastener chain, it is also possible that the linear material for the stop implement is pressed and heated by the supersonic process or the like to be attached.

The stop implement according to the invention includes a conventional metal made stop implement in a lateral C-shape or a lateral H-shape in a cross section and a welded stop implement to weld the element coupling end portion directly or through a welding tape piece. The stop portion forming unit according to the invention is provided with a punch and a die, or a heating and welding device and a supersonic welding device and the like are set. Therefore, the formation of the stop implement according to the invention includes attaching of the metal made stop implement or the formation of the welded stop implement.

According to the embodiment, the fastener chain 4 is transferred by a manual work, however, the present invention is not limited to this. For example, the slider, the stop implement and the like may be attached to the fastener chain transferred by a gripper device holding the front end portion of the fastener chain 4.

Figure 13:
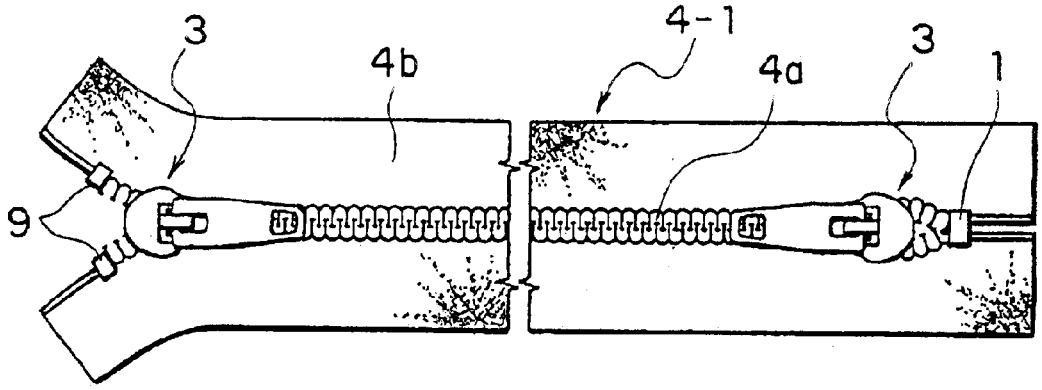
FIG. 13 is a plane view for showing an example of a slide fastener manufactured by the apparatus.
Figure 14:
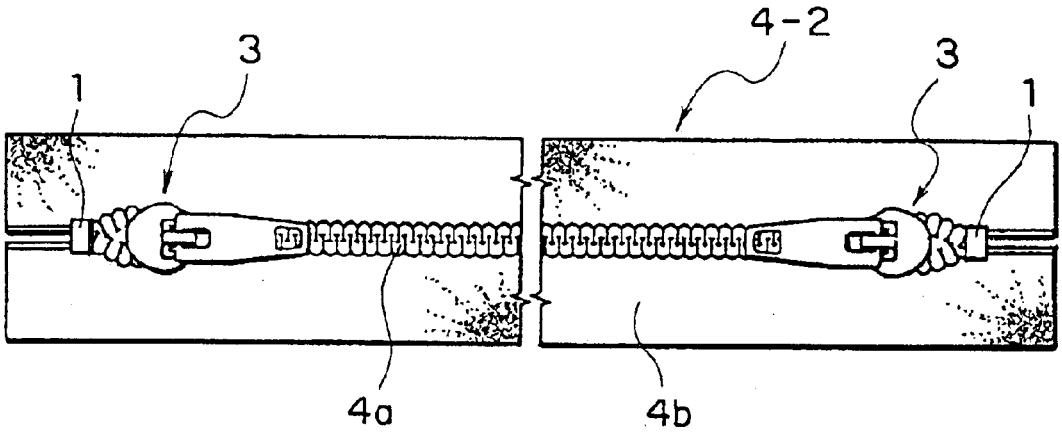
FIG. 14 is a plane view for showing a modified example of the slide fastener.
Figure 15:
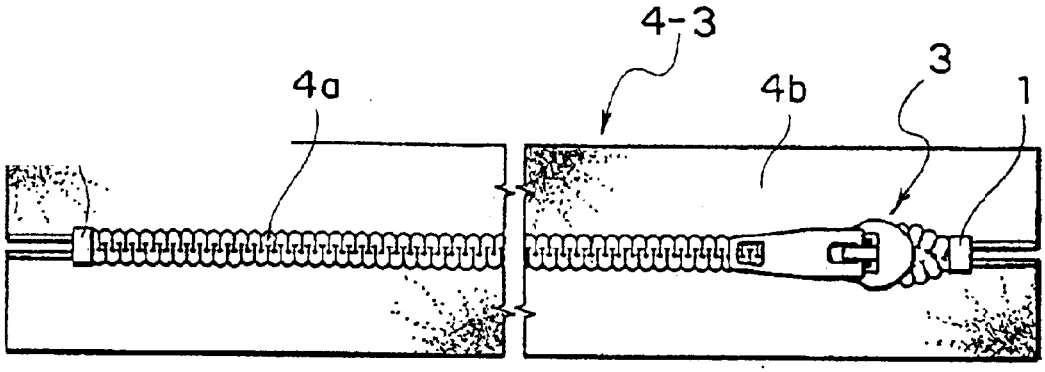
FIG. 15 is a plane view for showing other modified example of the slide fastener.

According to the slide fastener finishing apparatus 10 of the invention provided with the above described constitutions, it is possible to produce slide fasteners 4-1 to 4-3 provided with one or two sliders 3 as shown in FIGS. 13 to 15.

Figure 12:
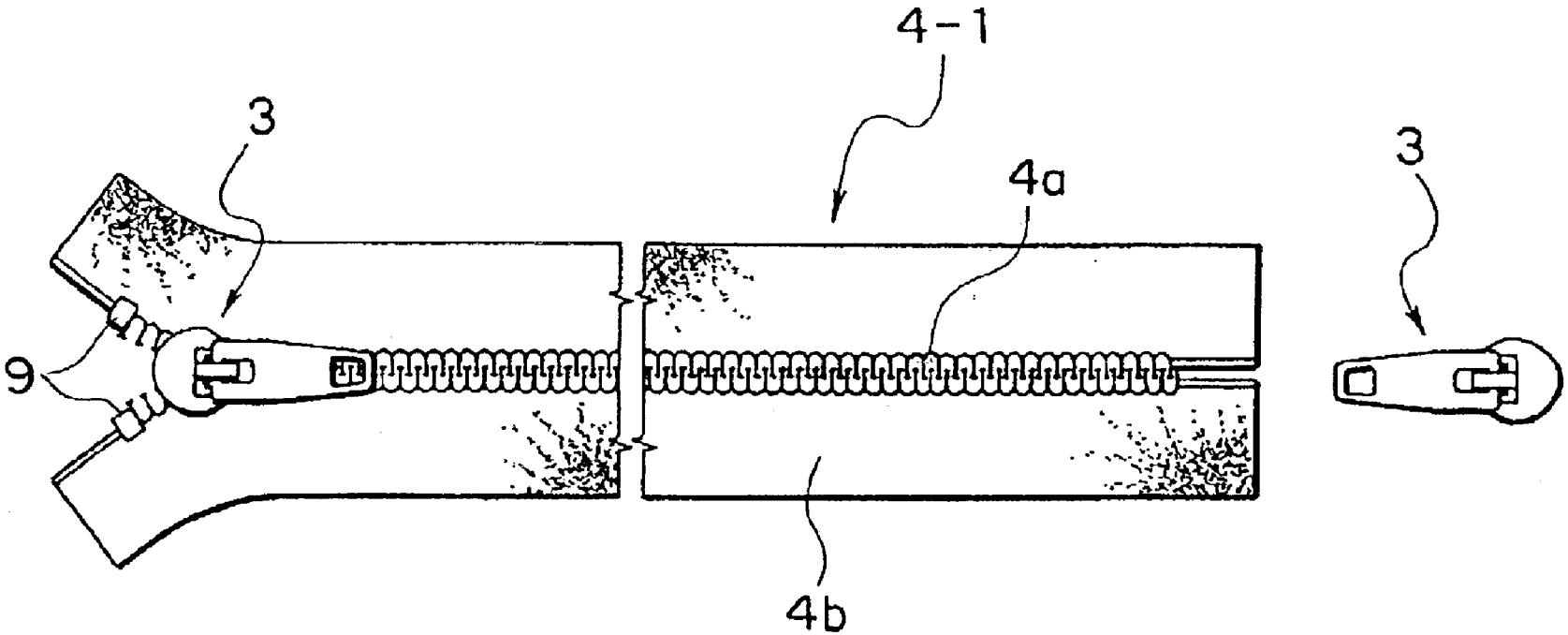
FIG. 12 is a plane view of a fastener chain before a single stop portion is attached thereto.

FIG. 12 shows a condition that, in the slide fastener 4-1 shown in FIG. 13, one slider 3 is attached to an upper stop implement 9 side in advance and the second slider 3 is inserted from the coupled element rows 4*a* at the lower stop side from its rear opening.

In this condition, by the use of the slide fastener finishing apparatus 10 of the invention, as described above, the coupled element rows 4*a* are inserted from the rear opening of the slider 3, the separated element rows 4*a* fed out from the shoulder side of the slider 3 are coupled again and the single stop implement 1 is attached, so that it is possible to obtain the slide fastener 4-1, to which two sliders 3, 3 are attached with their rear openings being opposed, as shown in FIG. 12. This slider fastener 4-1 is used, for example, for a boiler suit, children's clothing or the like, such that the slide fastener 4-1 may be opened from the both of the upper and the lower sides of the clothing. Consequently, it becomes possible for a wearer to easily do one's needs.

FIG. 14 and FIG. 15 show respectively modified examples of a slide fastener manufactured by the slide fastener finishing apparatus 10 according to the invention. The slide fastener shown in FIG. 14 is the same as the one shown in FIG. 13 in that two sliders 3 are provided, however, FIG. 14 is different from FIG. 13 in that the single stop implements 1 not capable of being separated are attached at the opposite end portions of the element rows 4*a*. This slide fastener 4-2 may be used for an opening, for example, of a bag, a pen case or the like. Alternatively, 15 illustrates an example such that the single slider 3 is attached to the slide fastener 4-1 shown in FIG. 14. For example, this slide fastener 4-3 may be used for a handbag, a coin purse, a rice bag, a pocket of the clothing or the like.

What is claimed is:

1. A slide fastener finishing apparatus, in which a pair of coupled right and left element rows of a fastener chain are capable of being inserted at a rear opening of a slider, separated as they pass through the slider, and re-coupled after exiting the slider comprising:

a slider passing portion disposed on a transfer path of the fastener chain, wherein the slider passing portion is capable of holding the slider such that the rear opening of the slider is capable of receiving the right and left element rows of the fastener chain; and an element coupling portion disposed at a chain downstream side of the slider passing portion, wherein the element coupling portion comprises an introduction guide piece which is capable of introducing and aligning the separated right and left element rows, and further comprises an element coupling piece for coupling elements of the separated element rows.

2. The slide fastener finishing apparatus according to claim 1, wherein the slider passing portion has a fitting concave portion for fitting and supporting a lower plate of the slider as well as has a suction opening on a bottom face of the fitting concave portion.

3. The slide fastener finishing apparatus according to claim 1, wherein a slider fixing member being movable up and down and having contact surfaces contacting a portion of an upper surface of the slider on a lower face side of the slider fixing member is provided on an upper part of the slider passing portion.

4. The slide fastener finishing apparatus according to claim 3, wherein the slider fixing member further comprises an introduction guide portion for a fastener chain and a chain introduction opening of the introduction guide portion has an inclined surface inclined downward in a chain introduction direction.

5. The slide fastener finishing apparatus according to claim 3, wherein the element coupling portion moves up and down in cooperation with the slider fixing member.

6. The slide fastener finishing apparatus according to claim 5, wherein the introduction guide piece is projected so as to guide separated element rows along the introduction guide piece at an upstream side of a chain introduction direction on a lower surface of the element coupling member, and a pair of projected side wall pieces for coupling the element rows at a downstream side of the chain introduction direction.

7. The slide fastener finishing apparatus according to claim 5, including interval changing means for enabling an interval between the element coupling portion and the slider fixing member to be changed.

8. The slide fastener finishing apparatus according to claim 1, wherein the element coupling piece further includes a pair of right and left side wall pieces for coupling elements of the separated element rows disposed at the chain downstream side of the introduction guide piece.

9. The slide fastener finishing apparatus according to claim 1, wherein a stop portion forming unit is further disposed at the chain downstream side of the element coupling portion to connect coupling end portions of the right and left element rows.

10. The slide fastener finishing apparatus according to claim 9, wherein the stop portion forming unit includes:

stop portion forming members which are provided movably forward and backward toward a fastener chain and form a stop portion at a coupling end of the fastener chain; and a tape pressing and holding member which is provided movably forward and backward toward the fastener chain and presses and holds right and left fastener tapes on a support table.

11. The slide fastener finishing apparatus according to claim 10, wherein the tape pressing and holding member is disposed between the stop portion forming members and the support table, has an insertion guide path, through which the stop portion forming members are capable of being inserted, and presses and holds the right and left fastener tapes on the support table with overpassing the element rows.

12. The slide fastener finishing apparatus according to claim 11, wherein the tape pressing and holding member has a tube for guiding the movement back and forth of the stop portion forming members.

13. The slide fastener finishing apparatus according to claim 11, wherein the stop portion forming members are composed of a cutting punch for cutting a linear material as a raw material of a stop portion into a stop piece with a certain length and a driver punch for pressing an upper surface of the stop piece and hammering this piece into the fastener tape; and the tape pressing and holding member regulates a descending position of the cutting punch as well as guides the ascending and descending of the driver punch.

* * * * *